US006375319B1

(12) United States Patent
Kamano et al.

(10) Patent No.: US 6,375,319 B1
(45) Date of Patent: Apr. 23, 2002

(54) INK-JET PRINTER

(75) Inventors: Tadao Kamano, Shizuoka-ken; Shinichiro Fujii, Mishima; Akira Nuita, Shizuoka-ken; Izumi Araki, Mishima; Takuro Ito, Shizuoka-ken; Yasuhiro Suzuki, Numazu; Hiroyuki Takada, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/135,518

(22) Filed: Aug. 13, 1998

Related U.S. Application Data

(63) Continuation of application No. PCT/JP97/04725, filed on Dec. 19, 1997.

(30) Foreign Application Priority Data

Dec. 19, 1996 (JP) ..... 8-340079
Jan. 22, 1997 (JP) ..... 9-009718

(51) Int. Cl.[7] ..... B41J 2/01
(52) U.S. Cl. ..... 347/104
(58) Field of Search ..... 347/101, 104; 346/138; 271/196, 193, 272; 399/159, 303, 304, 312, 313, 316

(56) References Cited

U.S. PATENT DOCUMENTS 4,138,102 A * 2/1979 Palmer ..... 346/138
4,674,860 A * 6/1987 Tokunaga et al. ..... 399/303
5,249,023 A * 9/1993 Miyuashiro et al. ..... 271/193
5,455,604 A * 10/1995 Adams et al. ..... 347/104

FOREIGN PATENT DOCUMENTS

| | | | |
|---|---|---|---|
| EP | 0 518 674 A | 12/1992 | ..... B41J/13/22 |
| FR | 2 380 675 A | 9/1978 | ..... B41J/13/10 |
| JP | 61-293877 | 12/1986 | ..... B41J/13/02 |
| JP | 2-175537 | 7/1990 | ..... B41J/13/00 |
| JP | 8-72326 | 3/1996 | ..... B41J/3/54 |

* cited by examiner

*Primary Examiner*—John Barlow
*Assistant Examiner*—Ly T Tran
(74) *Attorney, Agent, or Firm*—Frishauf, Holtz, Goodman, Langer & Chick, P.C.

(57) ABSTRACT

An ink-jet printer includes a rotary drum 10 for rotating at a constant speed, a sheet loader for loading a paper sheet onto the rotary drum 10, a sheet holding system 20 for holding the paper sheet loaded by the sheet loader on the rotary drum 10, and a print head 200 for printing an image by ejecting ink onto the paper sheet which is held on the rotary drum 10 by the sheet holding system 20 and rotated together with the rotary drum 10. In particular, the sheet loader has a pair of loading rollers 91 and 92 for feeding the paper sheet while pinching the paper sheet, and a roller moving mechanism 28 for separating the loading roller 91 from the other loading roller 92 to release the paper sheet after the leading edge of the paper sheet has been held on the rotary drum 10.

2 Claims, 5 Drawing Sheets

INK-JET PRINTER

CROSS-REFERENCE TO RELATED APPLICATIONS

This is a Continuation Application of international Application No. PCT/JP97/04725, filed Dec. 19, 1997, the entire contents of which are incorporated herein by reference.

BACKGROUND OF THE INVENTION

The present invention relates to an ink-jet printer for ejecting ink onto a paper sheet held on a rotary drum to perform printing.

Recently, personal computers of high performance and low cost has become available, and the spread of personal computers has abruptly increased. In accordance with this trend, color printers have been also increasingly demanded. At the present stage, various types of ink-jet printer exist as color printers suitable for personal use.

Conventionally, there is a known ink-jet printer which can perform a continuous printing of 500 or more sheets, for example. This ink-jet printer has a rotary drum which rotates at a predetermined circumferential speed, and a print head for ejecting color inks onto a sheet of paper held on the peripheral surface of the rotary drum. The sheet is fed to the rotary drum from the front side of the rotary drum, printing is performed in a state where the paper sheet is wound on the rotary drum. After printing, the paper sheet is separated from the rotary drum and discharged to the rear side of the rotary drum.

The print head includes nozzle units of, for example, yellow, cyan, magenta and black which are disposed along the peripheral surface of the rotary drum. Each of the nozzle units has ink-jet nozzles which are arranged across the paper sheet in the main scanning direction parallel to the axis of the rotary drum and eject inks as the rotary drum rotates. Each nozzle unit is shifted in the main scanning direction at a predetermined rate, and returned to its initial position after a predetermined number of rotations for causing the nozzle unit to be moved by a distance equal to the nozzle pitch. Each nozzle unit scans the paper sheet simultaneously in the main scanning direction and the sub-scanning direction as described above, so as to eject ink onto the entire paper sheet.

In a case where positional deviation or warp-up of the paper sheet occur when it is placed on the rotary drum of the ink-jet printer, incorrect alignment is caused between dots of color inks and significantly deteriorates the printing quality.

BRIEF SUMMARY OF THE INVENTION

An object of the present invention is to provide an ink-jet printer which can prevent positional deviation of a print medium held on the rotary drum.

According to a first aspect of the present invention, there is provided an ink-jet printer which comprises a rotary drum for rotating at a constant speed, a medium loading mechanism for loading a print medium onto the rotary drum, a medium holding section for holding the print medium loaded by the medium loading mechanism on the rotary drum, and a print head for printing an image by ejecting ink onto the print medium which is held on the rotary drum by the medium holding section and rotated together with the rotary drum, wherein the medium loading mechanism has a pair of loading rollers for feeding the print medium while pinching the printing medium, and a separating mechanism for separating one of the loading rollers from the other roller to release the print medium after a leading edge of the print medium has been held on the rotary drum.

According to a second aspect of the present invention, the medium holding section of the ink-jet printer according to the first aspect has a charging roller for electrically charging the print medium while pressing the print medium onto the rotary drum, such that the print medium is held on the rotary drum by electrostatic attraction, and a separating mechanism for separating the charging roller from the rotary drum after a predetermined rear part of the print medium has passed the charging roller.

In the ink-jet printer according to the first aspect, the separating mechanism separates one of the loading rollers from the other roller to release the print medium after the leading edge of the print medium has been held on the rotary drum. When the loading rollers are spaced from each other, the print medium is set in a free state where no pinching force is applied from the loading rollers. Therefore, the rotation load on the rotary drum can therefore be reduced. In this case, since the print medium is securely held on the rotary drum, positional deviation and warp-up thereof are avoided. Thus, the printing quality is improved.

In the ink-jet printer according to the second aspect, the charging roller electrically charges the print medium loaded by the medium loading mechanism while pressing the printing medium onto the rotary drum. Therefore, charging of the print medium can be started upon loading of the print medium from the medium loading mechanism and continued until the predetermined rear part of the print medium passes the charging roller.

Furthermore, the charging roller is separated from the rotary drum after the predetermined rear part of the print medium has passed the charging roller. Thus, the charging roller would not touch the ink ejected onto the print medium even if the rotary drum is repeatedly rotated to obtain a printed image. This contributes to preserve the print in high quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to the first embodiment of the present invention will now be described, with reference to FIGS. 1 to 5. This ink-jet printer is used to perform a multicolor printing on a sheet of paper M cut as a print medium. This paper sheet M is a plain paper or OHP sheet.

Figure 1:
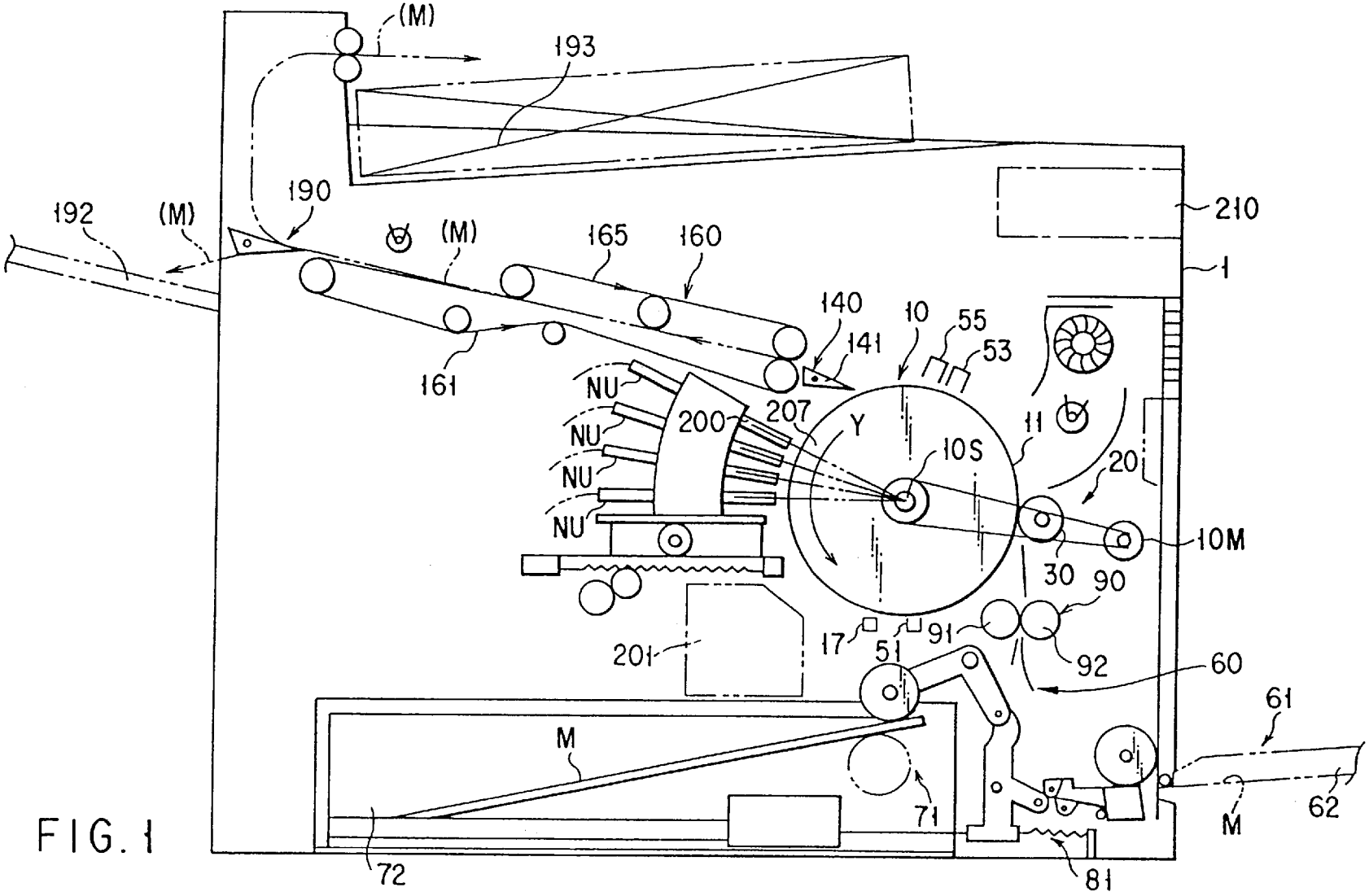
FIG. 1 is a sectional view showing the internal structure of an ink-jet printer according to a first embodiment of the present invention.

FIG. 1 shows the internal structure of the ink-jet printer. The ink-jet printer includes a rotary drum 10 which holds a paper sheet M and rotates at a predetermined circumferential speed; a print head 200 for performing a multicolor printing on the paper sheet M rotating together with the rotary drum 10; a manual feed tray 62 for placing a paper sheet M to be fed one by one; a paper cassette 72 for containing a stack of paper sheets M fed thereto; a sheet feed-in mechanism 60 for feeding a paper sheet M to the rotary drum 10 from the paper cassette 72 and the manual feed tray 62; a sheet feed-out mechanism 160 for feeding out the paper sheet M printed at the rotary drum 10; and a control unit 210 for controlling the overall operation of the ink-jet printer. As is shown in FIG. 1, the rotary drum 10 is located near the central position in a housing 1, the manual feed tray 62 is located below the rotary drum 10 and projects externally from a front surface of the housing 1, and the paper cassette 72 is located under the rotary drum 10. The sheet feed-in mechanism 60 is located between the manual feed tray 62 and the paper cassette 72. The print head 200 is located behind the rotary drum 10. The sheet feed-out mechanism 160 is located behind the rotary drum 10 and above the print head 200.

The rotary drum 10 is pivotally supported about a shaft 10S, and has a sheet holding system 20 for holding the paper sheet M wound around the peripheral surface 11 in accordance with rotation thereof. The rotational position of the rotary drum 10 is detected by a rotational position detector 17, which is disposed near the peripheral surface of the rotary drum 10. The print head 200 is constituted by four nozzle units NU which are arranged along the peripheral surface 11 of the rotary drum 10 and performs printing on the paper sheet M with yellow, cyan, magenta and black inks, respectively. These nozzle units NU are supplied with the respective inks from four ink supply sections 201 disposed apart therefrom. Each nozzle unit NU has a plurality of ink-jet nozzles 207 which are arranged at a pitch of, for example, 1/75 inch in the axial direction of the rotary drum 10 to eject ink of a corresponding color onto the paper sheet M. The ink-jet nozzles 207 are arranged to have a length corresponding to the width of the paper sheet M of A4 size, i.e., 210 mm. The sheet feed-in mechanism 60 includes a sheet loader 90 for loading the paper sheet M to the rotary drum 10 such that the width direction of the sheet is aligned with the axial direction of the rotary drum 10; a manual feeder 61 for taking the paper sheet M from the manual feed tray 62 and feeding it to the sheet loader 90; a cassette feeder 71 for taking the paper sheet M from the paper cassette 72 and feeding it to the sheet loader 90; and a feed switch section 81 for driving one of the manual feeder 61 and the cassette feeder 71. The sheet loader 90 is controlled to load the paper sheet M toward the rotary drum 10 when the position detector 17 has detected that the rotary drum 10 has arrived at a predetermined position. The paper sheet M is held on the peripheral surface 11 of the rotary drum 10 by means of the sheet holding system 20. The print head 200 prints a color image on the paper sheet M as the rotary drum 10 rotates.

After printing, the paper sheet M is separated from the peripheral surface 11 of the rotary drum 10 by a separating claw 141 of a sheet separator 140, and fed in a predetermined direction by the sheet feed-out mechanism 160 which is made up of a feed belt conveyor 161 and a press belt conveyor 165. A discharge switch 190 guides the paper sheet M to a selected one of a rear discharge tray 192 for discharging the sheet with its printed surface facing upward, and an upper discharge tray 193 for discharging the sheet with its printed surface facing downward.

The print head 200 is movable in a main scanning direction X parallel to the axis of the rotary drum 10, and is also movable between a print position adjacent to the peripheral surface 11 of the rotary drum 10 and a stand-by position remote from the print position.

The rotary drum 10 holds the paper sheet M wound on the peripheral surface 11 thereof and rotates such that the sheet is opposed to the nozzle units NU and moved in a sub-scanning direction Y perpendicular to the main scanning direction X. The rotary drum 10 is kept at a constant rotational speed of 120 rpm to achieve a multicolor printing of, for example, 20 PPM. That is, the rotary drum 10 is rotated at one revolution per 0.5 sec. During printing, each nozzle unit NU is shifted in the main scanning direction X by a constant rate of ¼ nozzle pitch PT each time the rotary drum 10 makes one revolution, so that it moves by a distance equal to the nozzle pitch PT during four revolutions. With this structure, the printing of the entire paper sheet M is completed in 2 seconds (=0.5 second×4) required to make four revolutions of the rotary drum 10. Even taking into consideration a time required to make one revolution of the rotary drum 10 for winding up the paper sheet M before printing and one revolution of the rotary drum 10 for separating the paper sheet M after printing, a multicolor image can be printed on the paper sheet M of A4 size at a high speed of 3 (=2+1) seconds per sheet. Thus, printing can be consecutively performed on 20 paper sheets every minute.

The sheet loader 90 is constituted by at least a pair of loading rollers 91 and 92 extending in the axial direction of the drum to load the paper sheet M fed from the feeder 61 or 71 to the rotary drum 10 at a predetermined timing. The loading speed of the paper sheet M is set at a value corresponding to the circumferential speed of the rotary drum 10.

At least one of the loading rollers 91 and 92 receives a rotating force applied from a main motor 10M which constitutes a feed force applying section together with a gear train, a clutch, and the like. The main motor 10M drives the loading rollers 91 and 92 under the control of the control unit 210, thereby forwarding the paper sheet M to the rotary drum 10.

Figure 2:
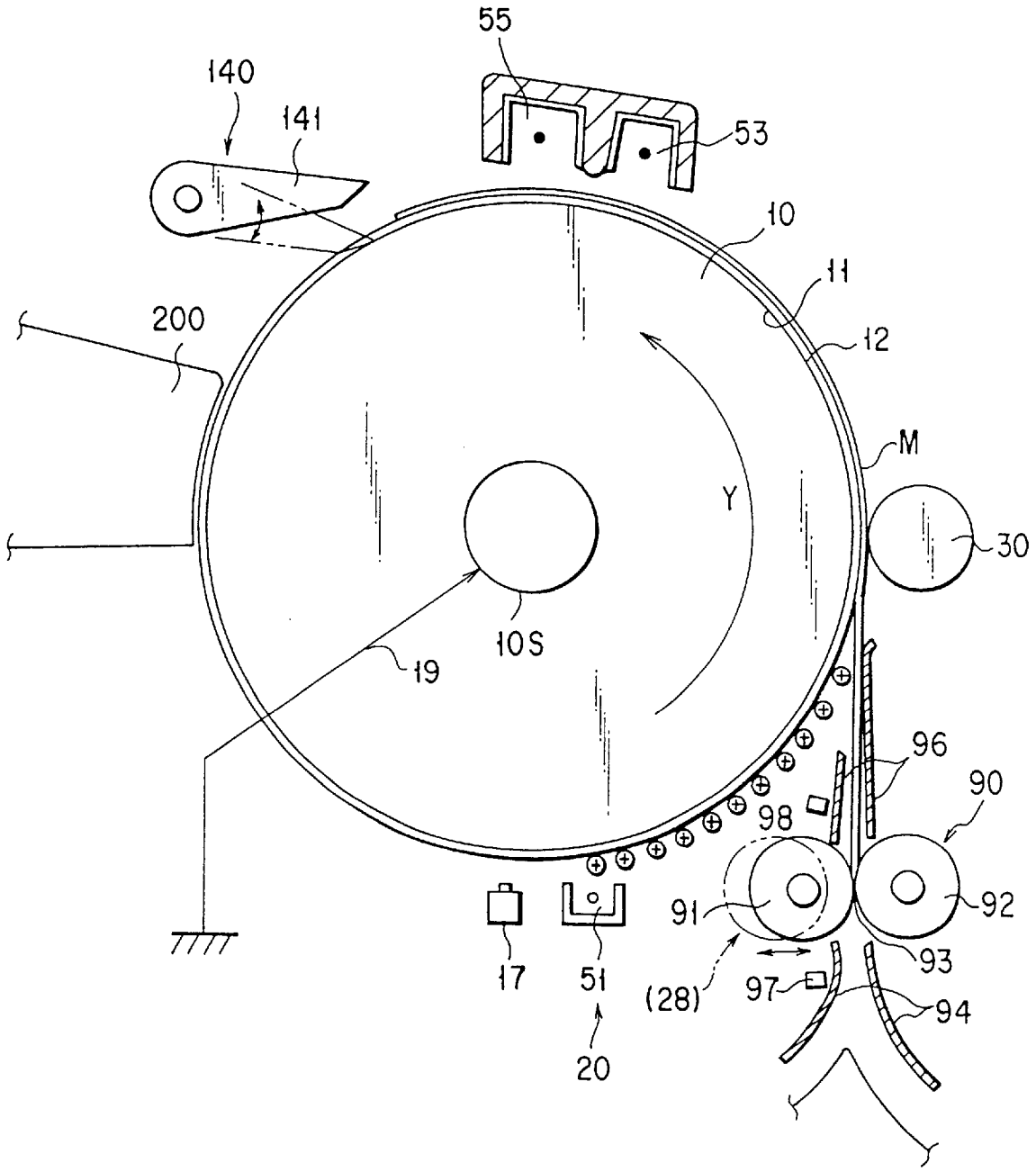
FIG. 2 is a diagram illustrating in detail components disposed around the rotary drum shown in FIG. 1.

The rotary drum 10 is rotated by the driving force of the main motor 10M transmitted to the shaft 10S via a timing belt, sprockets and gears. The main motor 10M is constituted by a servo motor, which has excellent quick-response and constantspeed characteristics. The rotary drum 10 is constituted by a cylindrical frame, and as shown in FIG. 2 the shaft 10S is electrically grounded by an earth wire 19. Since the diameter of the rotary drum 10 is set at 130 mm, a circumferential speed of 816 mm/sec=120 πd/60 is obtained. The peripheral surface 11 of the rotary drum 10 has a width of about 220 mm in the axial direction and a length of 408 mm (=πd) in the rotational direction. For this reason, the rotary drum 10 can satisfactorily hold an A4-size paper sheet M having a length of 297 mm and a width of 210 mm.

The rotational position detector 17 detects a notch, a projection or the like disposed at a predetermined position on the rotary drum 10 side, and is referred to by the control unit 210 to determine control timings.

Figure 3:
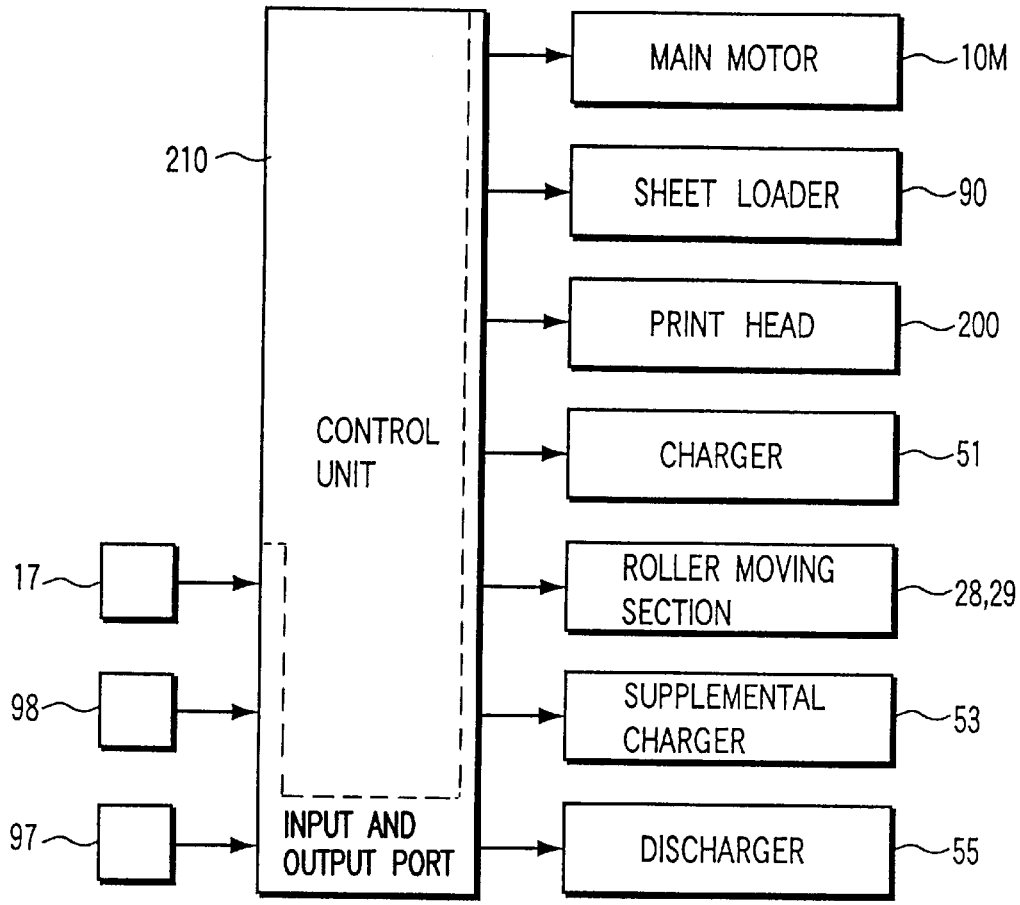
FIG. 3 is a block diagram showing the circuit of a control unit circuit for controlling the operation of the ink-jet printer shown in FIG. 1.

The control unit 210 is constituted by a CPU, a ROM, a RAM, a keyboard, a timepiece circuit, an input and output port, etc. As shown in FIG. 3, the input and output port is connected to the rotational position detector 17, sheet sensors 97 and 98, the main motor 10M, the sheet loader 90, the print head 200, a charger 51, roller moving sections 28 and 29, a supplemental charger 53, and a discharger 55, so that various controls can be made.

When it is detected by the rotational position detector 17 that the rotary drum 10 has arrived at the predetermined position, the sheet loader 90 is driven by the drive force from the main motor 10M under the control of the control unit 210 to forward the paper sheet M to the rotary drum 10. The sheet-holding system 20 clamps the leading edge of the paper sheet M with a clamp claw and holds an area from the leading edge to the trailing edge of the paper sheet M by negative-pressure suction and electrostatic attraction.

The peripheral surface 11 of the rotary drum 10 is made of a dielectric layer 12 having a high resistance. Components such as the charger 51, the supplemental charger 53, the discharger 55, and an insulation roller 30 are arranged around the peripheral surface 11. The insulation roller 30 is a rubber roller having a dielectric property, and is disposed to press the paper sheet M at a downstream position apart from the point where the leading edge of the sheet M is brought into contact with the peripheral surface 11, in the rotating direction of the rotary drum 10 (i.e., Y direction), so that the paper sheet M can be securely held on the peripheral surface 11 of the rotary drum 10 without warp-up thereof.

The loading rollers 91 and 92 of the sheet loader 90 correct the posture of the paper sheet M to be loaded to the rotary drum 10, and is capable of being set in a standby state that they do not pinch the paper sheet M. That is, when the leading edge of the paper sheet M fed from below as viewed in FIG. 2 is struck against the contact between the loading rollers 91 and 92, the paper sheet M is elastically deformed in an upstream guide 94. Thus, the leading edge of the paper sheet is aligned in parallel to the axis of the rotary drum 10, so that the paper sheet M can be loaded without skew. The posture correction can be promoted by an elastic restoring force of the paper sheet M obtained in the guide 94. The sheet sensor 97 is available to determine whether or not the posture correction has been made.

After the posture correction, both the loading rollers 91 and 92 feed the paper sheet M along the downstream guide 96 toward the rotary drum 10 until the sheet sensor 98 detects the leading edge of the paper sheet M. The leading edge of the paper sheet M is pinched between both loading rollers 91 and 92, and the trailing edge of the paper sheet M is released from the cassette feeder 71 or the manual sheet feeder 61 located below the guide 94. At this time, a preparation for loading of the paper sheet M to be printed next is completed, so that the paper sheet M can be loaded to the rotary drum 10 at a predetermined timing. After the leading edge of the paper sheet M is held on the peripheral surface 11, the roller moving section 28 is driven to separate the loading roller 91 from the loading roller 92 as is indicated by a two-dot chain line in FIG. 2. In this case, the trailing edge of the paper sheet M is set free to prevent a load from being applied on the rotary drum 10 which rotates the paper sheet M.

Figure 4:
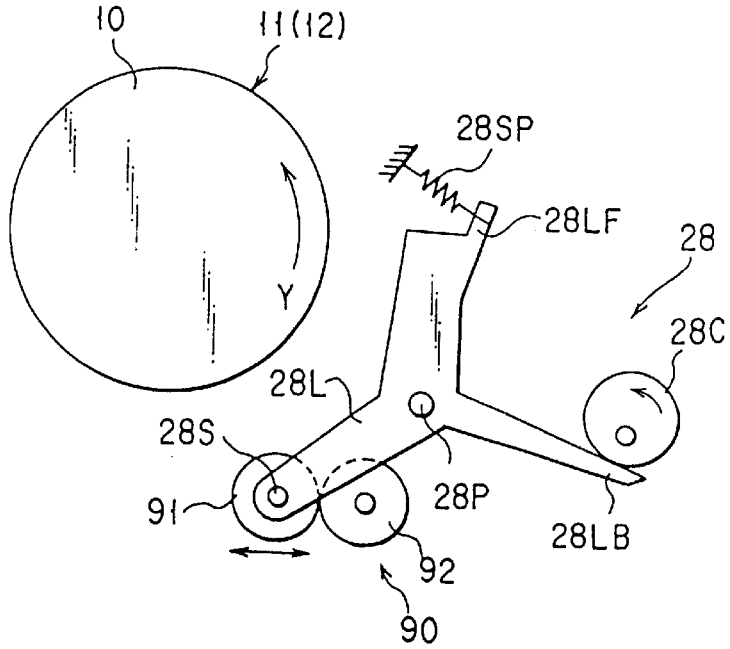
FIG. 4 is a diagram for explaining a loading roller moving section shown in FIG. 2.

The roller moving section 28 is driven under the control of the control unit 210 shown in FIG. 3. It moves forward to set the loading roller 91 in contact with the loading roller 92 and moves backward to separate the loading roller 91 from the loading roller 92. As shown in FIG. 4, the roller moving section 28 has a link lever 28L pivotal about a pin member 28, a spring 28SP for pulling the upper end 28LF of the link lever 28L to the left as shown in FIG. 4, and an eccentric cam 29C for pushing the lower end 28LB of the link lever 28L downwards as viewed in FIG. 4, against the tension of the spring 28SP. The loading roller 91 is pivotally coupled to the link lever 28L about an axle 28S. Accordingly, the loading roller 91 can be set in contact with the other loading roller 92 by a constant pressure corresponding to the urging force (tension) of the spring 28SP in a state where the lower end 28LB of the link lever 28L has not been pushed down by the eccentric cam 28C. The loading roller 91 is separated from the loading roller 92 is the lower end 28LB of the link lever 28L is pushed down by the eccentric cam 28C.

In addition, the insulation roller 30 is also separated from the peripheral surface 11 of the drum 10 by the roller moving section 29 after the paper sheet M has been held on the peripheral surface 11, so as to prevent the ink ejected from the print head 200 to the paper sheet M from being adhered to the neighboring components and then transferred back to the paper sheet M.

Figure 5:
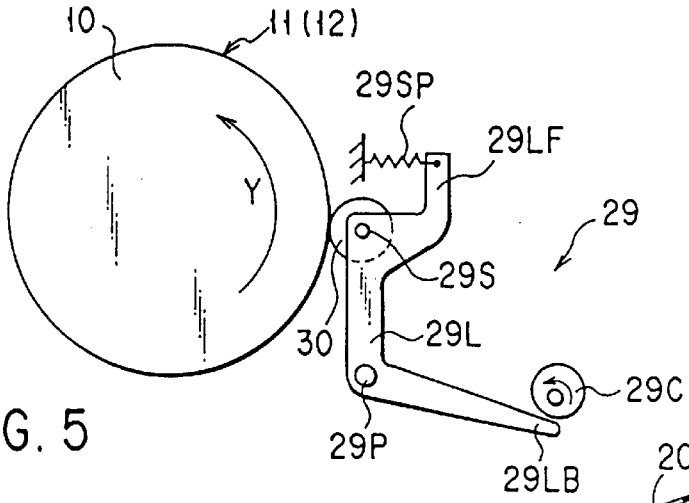
FIG. 5 is a diagram for explaining an insulation roller moving section shown in FIG. 2.

Like the roller moving section 28, the roller moving section 29 is driven under the control of the control unit 210. As shown in FIG. 5, the roller moving section 29 includes a link lever 29L pivotal about a pin member 29P, a spring 29SP for pulling the upper end 29LF of the link lever 29L to the left as shown in FIG. 5, and an eccentric cam 29C for pushing the lower end 29LB of the link lever 29L downwards as viewed in FIG. 5, against the tension of the spring 29SP. The insulation roller 30 is pivotally supported by the link lever about an axle 29S. Accordingly, the insulation roller can be set in contact with the peripheral surface 11 of the drum by a pressure corresponding to the urging force (tension) of the spring 29SP in a state where the lower end 29LB has not been pushed down by the eccentric cam 29C. The insulation roller 30 is separated from the peripheral surface 11 of the drum if the other end 29LB is pushed down by the eccentric cam 29C.

The operation of the ink-jet printer will be explained below.

When the rotational position detector 17 detects the rotary drum 10 has rotated to the predetermined position (or angle), the control unit 210 drives the sheet loader 90 to supply a paper sheet M set in the standby state, to the rotary drum 10 shown in FIG. 1 at a speed substantially equal to the circumferential speed of the rotary drum 10. The peripheral surface 11 of the drum is previously charged by the charger 51.

When the leading edge of the paper sheet M comes to contact with the peripheral surface 11 of the drum, the paper sheet M is held on the surface 11 by virtue of electrostatic attraction. After it is detected from a signal output of the rotational position detector 17 that the leading edge of the sheet M has passed the point where the insulation roller 30 contacts the peripheral surface 11 of the drum, the control unit 210 drives the roller moving section 28 to separate the loading roller 91 from the loading roller 92. As a result, the part of the sheet M, following the leading edge, is set free from both loading rollers 91 and 92 so as not to apply a rotation load to the rotary drum 10. Accordingly, the paper sheet M can be held on the peripheral surface 11 of the drum without positional deviation.

The paper sheet M is held on the peripheral surface 11 of the drum by electrostatic attraction as described above, and moved in the Y direction as the rotary drum 10 rotates. In this process, the insulation roller 30 keeps pressing the sheet M onto the peripheral surface 11 of the drum. Upward warping of the sheet M can be suppressed more reliably.

In addition, when it is detected from the rotational position detector 17 that the rotary drum 10 has made one revolution, the roller moving sections 29 is driven to separate the insulation roller 30 from the peripheral surface 11 of the drum.

Thereafter, the print head 200 prints an image on the paper sheet M by ejecting ink on the paper sheet M while the rotary drum further makes four revolutions. During this period, the supplemental charger 53 operates to stabilize the electrostatic attraction. Since the insulation roller 30 remains spaced from the peripheral surface 11 of the drum during the printing, the ejected ink would not contact the insulation roller 30 and contaminate the printed surface of the paper sheet M.

In this embodiment, the loading roller 91 is separated from the loading roller 92 when the paper sheet M begins to be held on the peripheral surface 11 of the rotary drum 10 from the leading edge thereof. Hence, it is possible to reduce the load applied on the drum in the case where the paper sheet M is held on the peripheral surface 11 of the drum. Accordingly, accuracy in positioning of the paper sheet M on the rotary drum 10 can be enhanced.

The insulation roller 30 is disposed downstream of the point where the leading edge of the sheet M contacts the peripheral surface 11 of the drum, in the rotation direction Y of the rotary drum 10, so as to press the paper sheet M onto the peripheral surface 11 of the drum. Both loading rollers 91 and 92 are moved away from each other when the leading edge of the paper sheet M passes the position where the insulation roller 30 contacts the peripheral surface 11 of the drum. This fully prevents the paper sheet M from being deviated on the peripheral surface 11 and from warping upwardly from the surface 11, so that a high-quality printing can be maintained stable.

In the embodiment described above, the insulation roller 30 is a rubber roller 30 having a dielectric property. Nonetheless, the roller 30 may be replaced by, for example, a charging roller.

An ink-jet printer according to the second embodiment of the present invention will be described with reference to FIGS. 6 to 12.

This ink-jet printer is similar to that according to the first embodiment, except for the matters described below. Components similar to those of the first embodiment are indicated by the same reference numerals and explanations thereof will be simplified or omitted.

Figure 6:
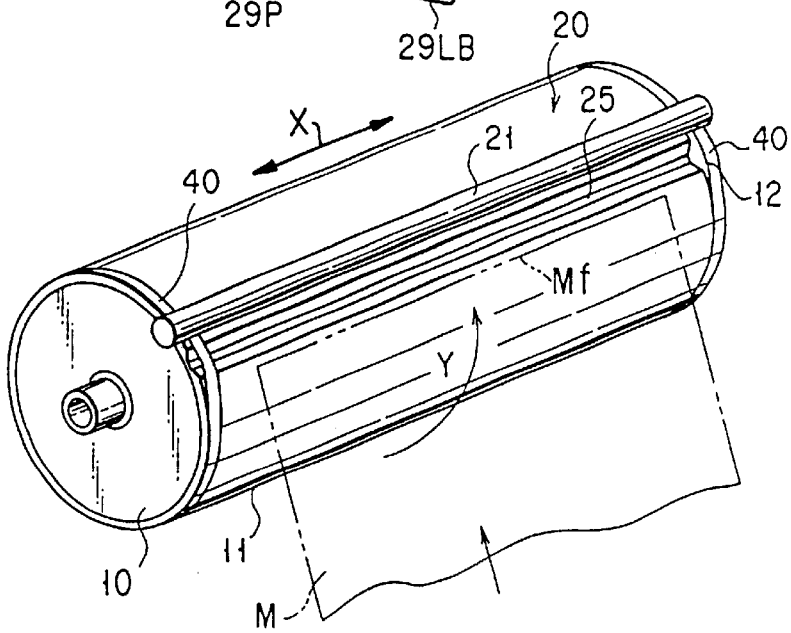
FIG. 6 is a perspective view of a rotary drum incorporated in an ink-jet printer according to a second embodiment of the present invention.
Figure 7:
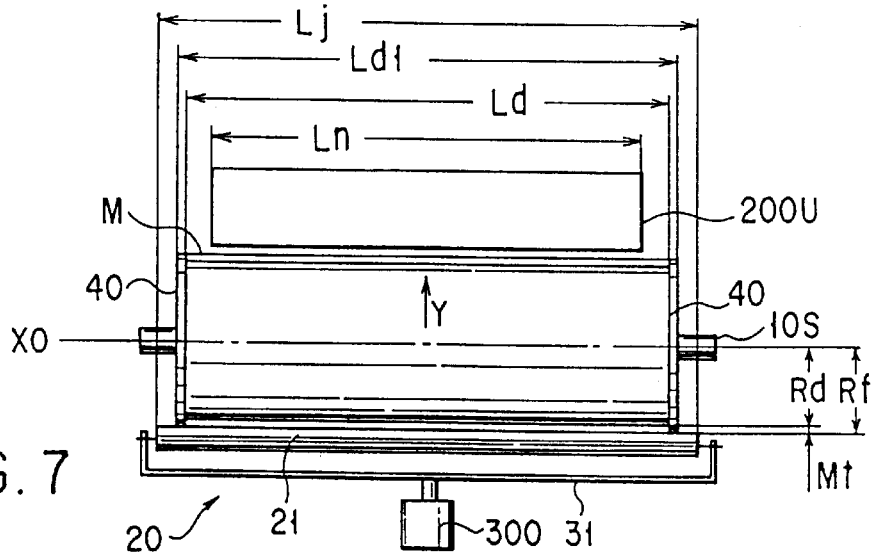
FIG. 7 is a plan view of the rotary drum shown in FIG. 6.

FIG. 6 shows the outer appearance of the rotary drum 10 incorporated in the ink-jet printer, and FIG. 7 shows the plane structure of the rotary drum 10 shown in FIG. 6. In this embodiment, sheet holding system 20 is arranged such that uses an electrostatic attraction force produced by a charging roller 21 is primarily used in place of the charger 51 and a mechanical holding force produced by clamp claws 25 is additionally used. In the peripheral surface 11 of the rotary drum 10, a groove 12 is formed to receive the clamp claws 25 which press and clamp the leading edge Mf of a paper sheet M. Two arcuate guides 40 are fastened to the ends of the rotary drum 10, respectively, spaced apart from each other in the axial direction of the drum 10. The radius Rf of each arcuate guide 40 is determined to be larger than the radius Rd of the rotary drum 10, at a position corresponding to that of the groove 12 in the peripheral surface 11 of the rotary drum, and determined to be equal to the radius Rd of the rotary drum 10 at positions corresponding to front and rear ends 41 and 42 located on both sides of the groove 12 in the rotation direction of the rotary drum 10. With this structure, the charging roller 21 can be prevented from falling into the groove 12 due to the arcuate guides 40.

As shown in FIGS. 6 and 7, the rotary drum 10 is rotatable about a shaft 10S in the Y direction. In this embodiment, the radius Rd is 65 mm and the drum 10 rotates at a speed of 120 rpm to achieve 20 ppm.

Figures 8, 9, 10, 11, 12:
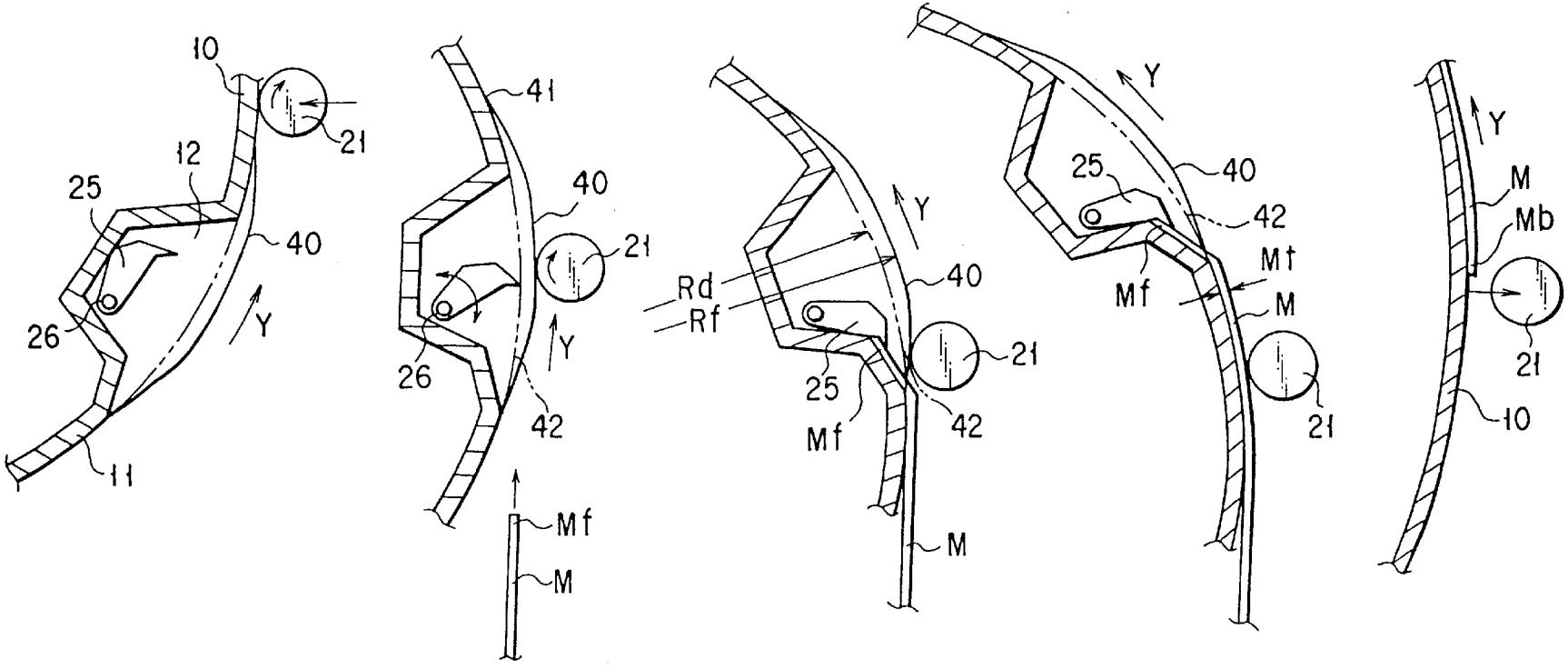
FIGS. 8 to 12 are diagrams for explaining changes of the positional relationship between the rotary drum and the charging roller shown in FIG. 7.

As shown in FIG. 7, the charging roller 21 is disposed close to the rotary drum 10 so that the paper sheet M can be held on the peripheral surface 11 of the rotary drum 10 by attraction, and the print head 200 is disposed close to the rotary drum 10 on the side opposite to the charging roller 21. The charging roller 21 is rotatably supported by a support member 31 and can be brought into contact with and separated from the peripheral surface 11 of the drum by means of a roller drive section 300 which is made up of a solenoid actuator, for example. The charging roller 21 is controlled by the control unit 210 such that it is brought into contact with the peripheral surface 11 at the print preparation time as shown in FIG. 8, and is separated from the peripheral surface 11 after passing a predetermined rear-part of the paper sheet M (the trailing edge Mb in FIG. 12).

The predetermined rear-part may be, for example, at a distance to from the trailing edge Mb toward the leading edge Mf, which is equal to a margin on the paper sheet M. Furthermore, the charging roller 21 may be separated from the peripheral surface 11 as soon as the trailing edge Mb passes the roller 21.

In the groove 12, the clamp claws 25 are arranged and separated in the axial direction XO of the drum 10, and are rotatably mounted about a shaft 26. The shaft 26 extends in the axial direction XO of the rotary drum 10 and can simultaneously rotate the clamp claws 25. The shaft 26 is driven by a force applied at a predetermined timing from a clamping and releasing mechanism which utilizes an external force and the rotational motion of the drum so as to perform clamping and releasing operations for the paper sheet M.

The two arcuate guides 40 are fitted to the ends of the rotary drum 10. Alternatively, they may be formed integral with the rotary drum 10. Each arcuate guide 40 has a radius Rf which is larger than the radius Rd of the rotary drum 10 at a position corresponding to the groove 12 and is equal to the radius Rd of the rotary drum 10 at positions corresponding to front and rear ends 41 and 42. That is, the front and rear ends 41 and 42 exist on an arc of the radius Rd likewise the peripheral surface 11. Hence, the charging roller 21 contacting the peripheral surface 11 can be smoothly moved from the peripheral surface 11 onto the arcuate guides 40. Therefore, the guides 40 guides the charging roller 21, preventing the same from falling into the groove 12 and, thus, from interfering with the clamp claws 25. Thereafter, the charging roller 21 can be smoothly moved from the arcuate guides 40 to the peripheral surface 11 again. This enables that the clamp claws 25 reliably clamp the leading edge Mf of the paper sheet M, and the charging roller 21 starts electrostatic charging immediately after the clamping and continues the charging for the entire length of the paper sheet M.

In a case where the rotary drum 10 is rotated faster in order to accomplish printing at higher speed, more smooth movement of charging roller 21 would be required with respect to the rotary drum 10.

Namely, the smaller the radius Rf of the arcuate guides 40, the better. The clamp claws 25 need to press and clamp a paper sheet M having a thickness Mt. In consideration of circular locus made by the motion of the clamp claws 25 rotating around the shaft 26, it is preferable that a part of each claw 25 is accepted to temporarily project from the peripheral surface 11 by an amount equal to or greater than the thickness Mt of the sheet M. If so, the clamping and releasing mechanism including the clamp claws 25 can be made simple, and it becomes easy for the claws 25 to reliably press and clamp the paper sheet M on the peripheral surface 11. For this reason, the radius Rf of each arcuate guide 40 is determined to be the sum (Rd+Mt) of the radius Rd of the drum and the thickness Mt of the paper sheet M. It would suffice if Rf>Rd+Mt, in view of the way the clamp claws 40 hold and release the sheet M and the speed of rotation of the rotary drum 10.

It is preferable that that part of each arcuate guide 40 which has a radius Rf≧(Rd+Mt) should have a length equal to or greater than the width of the groove 12. To enhance the use efficiency of the circumferential length of the drum 11, however, that part of each guide 40 may have a length shorter than the width of the groove 12 in condition that the clamping or releasing operation of the clamp claws 25 for the paper sheet M does not interfere with the guides 40. FIGS. 8 to 12 show the case where that part of each guide 40 has a length shorter than width of the groove 12.

Hence, the length Ln of the print head 200 in the axial direction XO shown in FIG. 7, the effective sheet holding length Ld of the rotary drum 10, the overall length Ld1 of the drum 10 and the overall length Lj of the charging roller 21 have the following relationship of: Ln<Ld<Ld1<Lj.

The operation of the ink-jet printer will be explained below.

As shown in FIG. 8, when the groove 12 becomes close to the loading position of the paper sheet M by the rotation of the rotary drum 10 in the Y direction, the control unit 210 drives the roller drive section 300 to bring the charging roller 21 into contact with the peripheral surface 11 of the drum and set it in a charging stand-by state.

As shown in FIG. 9, the charging roller 21 smoothly moves over the arcuate guides 41 via the front end of the arcuate guides 41 without falling into the groove 12.

As shown in FIGS. 9 and 10, the clamping and releasing mechanism starts the clamping operation at the time when the leading edge Mf of the paper sheet M is loaded to contact the peripheral surface 11 of the drum. To be more precise, the clamp claws 25 rotate around the shaft 26 and press the leading edge Mf of the sheet M onto to clamp the same on the peripheral surface 11. Since the paper sheet M is clamped at a plurality of points in the axial direction XO of the drum, it can be held on the rotary drum 10 at a correct position without a skew. While rotating, the clamp claws 25 would not interfere with the charging roller 21. This is because, RF>Rd.

As shown in FIG. 10, immediately after the clamp claws 25 press and clamp the leading edge Mf of the paper sheet M, the charging roller 21 contacts the leading edge Mf of the paper sheet M and starts electrostatic charging the paper sheet M. The paper sheet M can therefore be charged with high efficiency and reliably attracted onto the peripheral surface 11 of the drum.

As shown in FIG. 11, the charging roller 21 is smoothly moved onto the peripheral surface 11 of the drum via the rear ends 42 of the arcuate guides 40 while continuously charging the paper sheet M in the lengthwise direction thereof. Relative movement of the charging roller 21 along the peripheral surface 11 of the drum is effected not only to continuously charge the paper sheet M, but also rubs the sheet M in the lengthwise direction thereof. The paper sheet M can therefore be held on the peripheral surface 11 of the drum, more reliably and more uniformly than otherwise.

As shown in FIG. 12, the roller drive section 300 is separated from the roller 21 from the peripheral surface 11 of the drum immediately before or after the charging roller 21 passes (or leaves) the trailing edge Mb of the paper sheet M whose holding operation is started from the leading edge Mf thereof. The charging roller 21 will never touch the ink applied to the paper sheet M for printing. Therefore, the printing quality can be maintained.

In the embodiment described above, electrostatic charge is applied to a paper sheet M from charging roller 21 to obtain an electrostatic attraction force, and ink is ejected to print an image onto the paper sheet which is held on the peripheral surface 11 of the rotary drum 10 rotatable about shaft 10S, using the electrostatic attraction force. The charging roller 21 is separated from the peripheral surface 11 of the drum after the roller 21 passes the trailing edge of the paper sheet M. Therefore, the electrostatic attraction force of attracting the paper sheet M to the peripheral surface 11 of the drum can be efficiently obtained while maintaining the high quality printing.

As mentioned above, the groove 12 is made in the peripheral surface 11 of the rotary drum 10 to receive the clamp claws 25 capable of pressing and clamping the leading edge Mf of a paper sheet M onto the drum 10. Further, a plurality of arcuate guides 40 are provided and spaced apart from each other in the axial direction of the drum 10. The radius Rf of each arcuate guide 40 is determined to be larger than the radius Rd of the rotary drum 10 at a position corresponding to that of the groove 12 in the peripheral surface 11 of the rotary drum, and determined to be equal to the radius Rd of the rotary drum 10 at positions corresponding to the front and rear ends 41 and 42 in the rotation direction of the rotary drum 10. With this structure, the charging roller 21 can be moved relatively without falling into the groove 12, and the mechanical clamping force and the electrostatic attraction force can be obtained without any interference.

As indicated above, the radius Rf of each arcuate guide 40 is equal to or greater than the sum of the radius Rd of the rotary drum 10 and the thickness Mt of the sheet M. The clamp claws 25 therefore do not interfere with the charging roller 21 moving over the arcuate guides 40, while rotating about the shaft 26 in the groove 12, with their tips moving in an arc, to press the paper sheet M onto the drum 10. Thus, a mechanism for enabling the clamp claws 25 to press and clamp the paper sheet M can be selected from many types.

As described above, that part of each arcuate guide 40 which has a radius Rf>(Rd+Mt) is determined to have a length equal to or greater than the width of the groove 12 in the circumferential direction of the rotary drum 10, and the rear end 42 is set close to the rear end of the groove 12 in condition that the clamping or releasing operation of the clamp claws 25 for the paper sheet M does not interfere with the charging roller 21. Hence, the paper sheet M can be held on the peripheral surface 11 of the drum by virtue of both a mechanical clamping force and an electrostatic attraction force.

Furthermore, the paper sheet M can be firmly held on the peripheral surface 11 since the charging roller 21 rubs the sheet M from the leading edge Mf toward trailing edge Mb thereof on the peripheral surface 11.

In an ink-jet printer for ejecting ink onto a paper sheet held on a rotary drum to perform printing, positional deviation of the print medium held on the rotary drum can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a rotary drum for rotating at a constant speed;

a print medium loading mechanism for loading a print medium onto said rotary drum;

a print medium holding section for holding the print medium loaded by said print medium loading mechanism on said rotary drum; and a print head for printing an image by ejecting ink onto the print medium;

wherein said print medium loading mechanism includes a pair of loading rollers for feeding the print medium while pinching the printing medium, and a separating mechanism for separating one of the loading rollers from the other roller to release the print medium after a leading edge of the print medium has been held on said rotary drum;

wherein said print medium holding section includes a charging roller for electrically charging the print medium while pressing the print medium onto said rotary drum, such that the print medium is held on said rotary drum by electrostatic attraction, and a separating mechanism for separating said charging roller from said rotary drum after a predetermined rear part of the print medium has passed said charging roller; and wherein said print medium holding section includes a groove made in a peripheral surface of said rotary drum and a clamp claw received in said groove, said separating mechanism having a pair of arcuate guides disposed on ends of said rotary drum in an axial direction of said rotary drum, a radius of each arcuate guide being larger than a radius of said rotary drum at a position corresponding to said groove to prevent said charging roller from falling into said groove, and being equal to the radius of said rotary drum at positions corresponding to both sides of said groove in a rotation direction of said rotary drum.

2. An ink-jet printer according to claim 1, wherein the radius of said arcuate guides is a least equal to a sum of the radius of said rotary drum and a thickness of said print medium.

* * * * *